United States Patent [19]

Beach, Jr. et al.

[11] 4,166,567

[45] Sep. 4, 1979

[54] POLYGONAL PAPERBOARD DRUM

[75] Inventors: Ralph L. Beach, Jr., Convent Station, N.J.; William R. Fuson, Wilmington, Del.

[73] Assignee: International Paper Company, New York, N.Y.

[21] Appl. No.: 848,619

[22] Filed: Nov. 4, 1977

Related U.S. Application Data

[63] Continuation of Ser. No. 692,435, Jun. 3, 1976, abandoned.

[51] Int. Cl.[2] ..... B65D 5/35; B65D 13/00

[52] U.S. Cl. ..... 229/23 BT; 229/41 C; 229/41 D; 229/45 R; 220/418; 220/408

[58] Field of Search ..... 229/41 C, 41 D, 14 BE, 229/14 BL, 14 BW, 45 R, 23 BT; 220/418, 408

[56] References Cited

U.S. PATENT DOCUMENTS

| | | | |
|---|---|---|---|
| 1,971,863 | 8/1934 | Lupton | 229/14 BE |
| 2,019,787 | 11/1935 | Leopold | 229/41 C |
| 2,200,818 | 5/1940 | Bergstein | 229/14 BE |
| 2,794,588 | 6/1957 | George et al. | 229/45 R |
| 2,801,782 | 8/1957 | Ingham | 229/14 BW |
| 2,922,562 | 1/1960 | Pellaton | 229/41 C |
| 3,559,867 | 2/1971 | Muskopf et al. | 229/14 BL |
| 3,643,856 | 2/1972 | Jones | 229/14 BL |
| 3,873,017 | 3/1975 | Blatt | 229/41 C |
| 3,937,392 | 2/1976 | Swisher | 229/41 C |

FOREIGN PATENT DOCUMENTS

| | | | |
|---|---|---|---|
| 6704139 | 9/1967 | Netherlands | 229/14 BL |

*Primary Examiner*—Joseph Man-Fu Moy
*Attorney, Agent, or Firm*—Ronald A. Schapira

[57] ABSTRACT

A polygonal paperboard drum that is formed from: a one-piece, upstanding, generally tubular, reinforcing member having at least six, foldably connected, substantially rectangular, upstanding, reinforcing flaps; and a one-piece body member having two sets of at least three, substantially rectangular, foldably connected, upstanding, side wall panels and a polygonal bottom panel of at least four sides, formed from two foldably connected polygonal bottom flaps and connected along its opposite sides to the central side wall panel of each set of side wall panels; the sets of side wall panels being located on opposite sides of the tubular reinforcing member and the side wall panels being bonded to the reinforcing flaps; the upstanding lateral sides of the sets of side wall panels being in substantially abutting relationship about the foldable connection between reinforcing flaps; and the upstanding lateral sides of the reinforcing member being in substantially abutting relationship about the foldable connection between side wall panels.

Provided in the drum is a bottom insert having a central polygonal bottom reinforcing flap of at least four sides, overlying substantially the entire bottom panel and provided on each side with an upstanding flap.

The reinforcing member and the body member are adapted to form a collapsed drum envelope, from which an erect and stable, polygonal drum can be formed by providing the bottom reinforcing flap in overlying relationship to the bottom panel of the body member.

6 Claims, 12 Drawing Figures

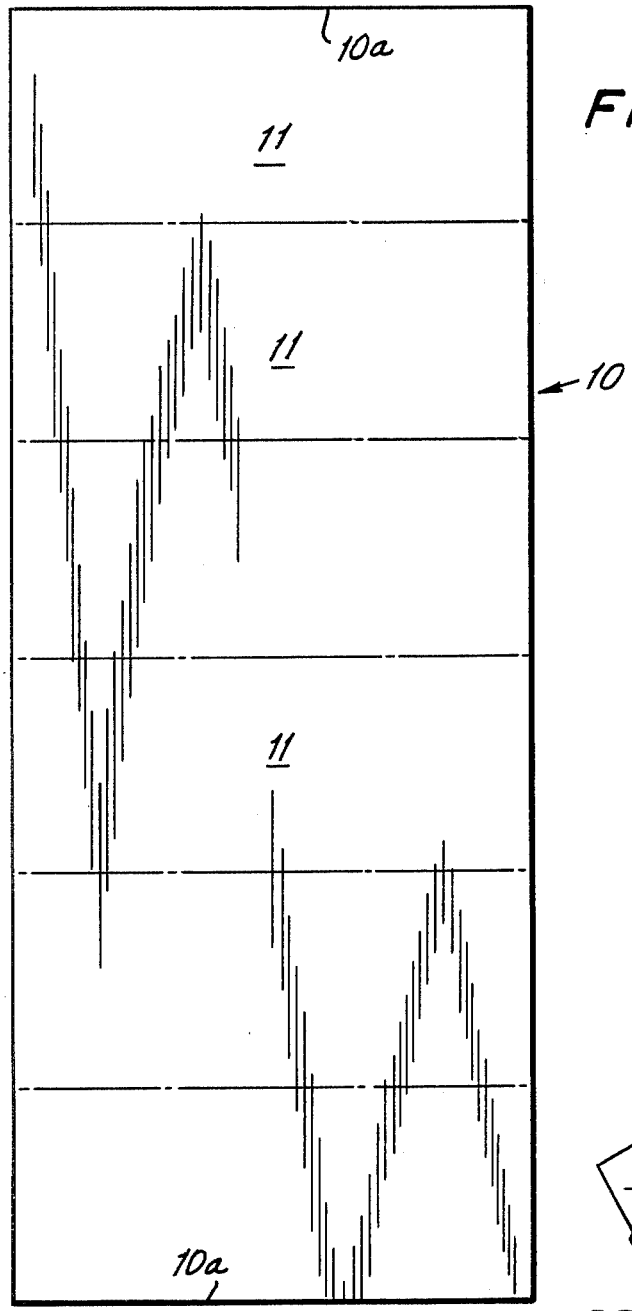
FIG. 1
FIG. 2
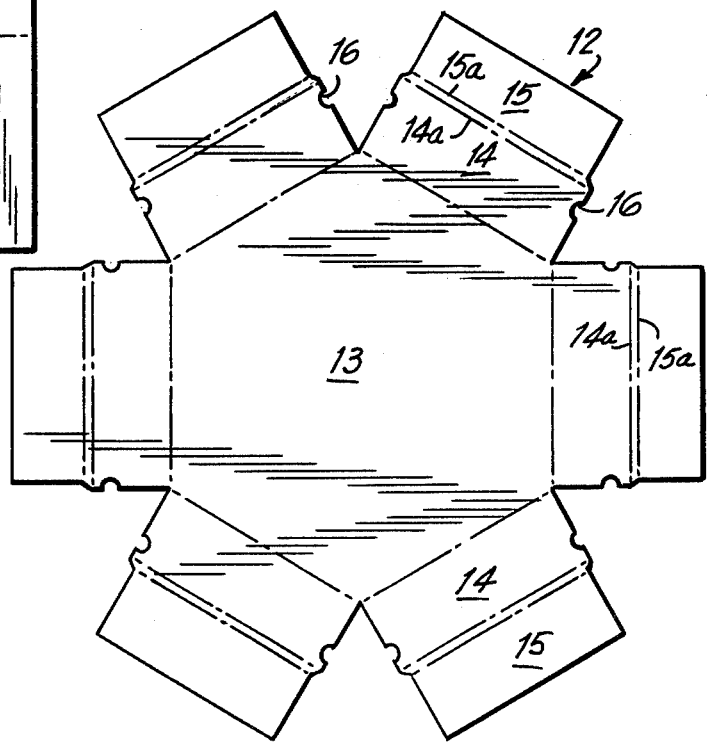

FIG. 9
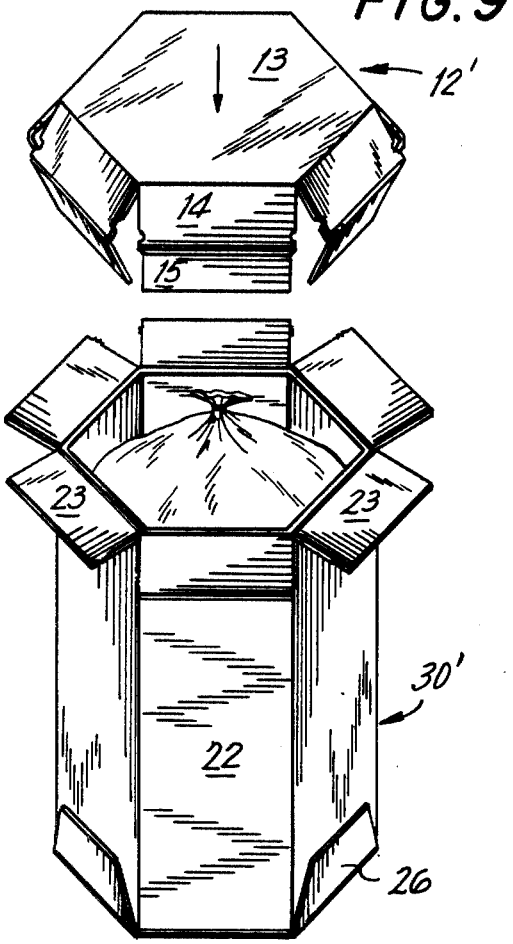
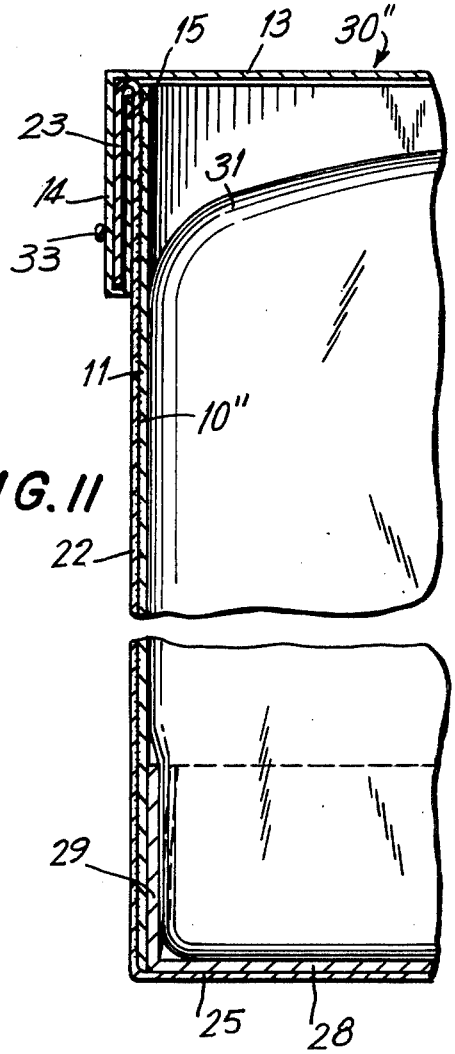
FIG. 11
FIG. 10
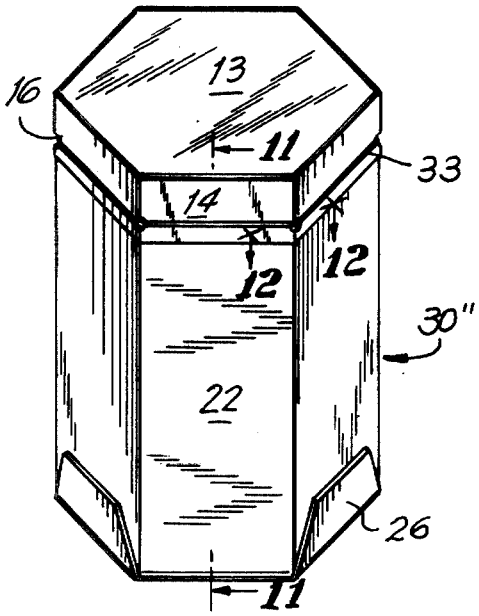
FIG. 12
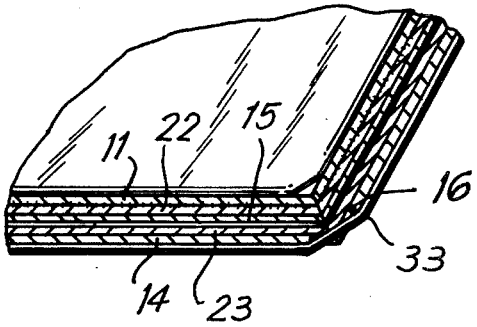

POLYGONAL PAPERBOARD DRUM

This is a continuation of application Ser. No. 692,435, filed June 3, 1976, entitled "Polygonal Paperboard Drum", now abandoned.

BACKGROUND OF THE INVENTION

This invention relates to a polygonal paperboard container, especially a polygonal drum suitable for holding relatively heavy quantities of materials, such as granular materials and the like. This invention particularly relates to a polygonal drum which has reinforced side walls and which can be erected from a collapsed drum envelope in a simple and expeditious manner. This invention quite particularly relates to a polygonal drum formed from a one-piece body member and a one-piece reinforcing member.

Polygonal paperboard containers formed from one-piece body members, having integral side wall panels and bottom panels, are known in the prior art. See, for example, the containers shown in U.S. Pat. Nos. 1,971,863, 2,808,193, 2,922,562, 2,965,280, 3,101,167 and 3,873,017. Certain of such polygonal containers have been adapted to be manufactured in a preassembled form as substantially flat or collapsed envelopes, from which the containers subsequently can be erected. See, for example, the containers in U.S. Pat. Nos. 1,971,863, 2,922,562, 3,101,167 and 3,873,017. Some of these polygonal containers also have been provided with side walls that are reinforced by additional layers of paperboard. See, for example, the containers in U.S. Pat. Nos. 1,971,863 and 3,873,017.

However, such polygonal paperboard containers, formed from one-piece body members, having reinforced side walls, and adapted to be erected from collapsed envelopes, generally have been rather difficult to produce in quantity, particularly when such containers have been designed as drums for holding relatively heavy quantities of materials. This is because the production of such polygonal containers typically has involved the relatively complicated and time-consuming steps of: overlapping numerous portions of their body members, particularly portions of their side wall panels; and then, securely bonding together such overlapped portions. Unfortunately, such overlapping of a significant number of portions of body members, particularly portions of side wall panels, and such subsequent bonding together of overlapped portions have been necessary steps in constructing many containers. Moreover, in some containers, such steps have been considered desirable in order to insure that the containers, so formed, are sufficiently strong for their intended purposes. Nevertheless, such overlapping and bonding operations have been quite expensive in terms of the time and effort needed to perform them. Also, when such steps have not been carried out properly, the containers formed have been prone to fail about their improperly overlapped and bonded together portions.

Thus, means have been sought for providing a polygonal container, particularly a drum for heavy quantities of materials, which is formed from a one-piece body member, has reinforced side walls, and is adapted to be erected from a collapsed envelope but which does not include numerous overlapped and adhesively bonded-together portions of its body member, particularly its side wall panels.

SUMMARY OF THE INVENTION

In accordance with this invention, a polygonal paperboard container is provided, which comprises:

a one-piece, upstanding, generally tubular, reinforcing member having at least six, foldably connected, substantially rectangular, upstanding, reinforcing flaps; and a one-piece body member having two sets of at least three, substantially rectangular, foldably connected, upstanding side wall panels and a polygonal bottom panel of at least four sides, connected along its opposite sides to the central side wall panel of each set of side wall panels;

the sets of side wall panels being located on opposite sides of the tubular reinforcing member and the side wall panels being bonded to the reinforcing flaps; and the upstanding lateral sides of the sets of side wall panels being in substantially abutting relationship about the foldable connection between reinforcing flaps, and the upstanding lateral sides of the reinforcing member being in substantially abutting relationship about the foldable connection between side wall panels.

The polygonal paperboard container provided by this invention includes only a minimum number of overlapped and bonded-together portions of its body member and does not include any overlapped and bonded-together portions of its side wall panels. This permits the container to be easily and quickly produced as a drum from its component paperboard elements. Yet, the drum, as formed, is strong enough to be filled with relatively heavy quantities, e.g., up to 2,5000 pounds, of a material, such as a granular material, and when filled, suitably handled, stacked and transported in a conventional manner.

Also in accordance with this invention, the polygonal paperboard container can be formed as a collapsed envelope and subsequently erected by providing, within the reinforcing member and the body member, a bottom insert having: a central polygonal bottom reinforcing flap of at least four sides, overlying substantially the entire bottom panel; and upstanding bottom insert flaps, provided on the sides of the bottom reinforcing flap.

Further in accordance with this invention, the body member preferably is formed from a cut and scored, paperboard blank, comprising:

two sets of substantially rectangular, foldably connected, side wall panels, arranged in a row; and a polygonal bottom panel, formed from two, foldably connected, bottom flaps of at least four sides and foldably connected along its opposite sides to the central side wall panel of each set of side wall panels;

wherein each set comprises only n side wall panels and the bottom panel has only 2n sides; and wherein n is an odd integer of 3 or greater.

BRIEF DESCRIPTION OF THE DRAWINGS

FIG. 1 is a plan view of a paperboard blank for a reinforcing member of this invention.

FIG. 2 is a plan view of a paperboard blank for a top member of this invention.

FIG. 9 is a perspective view of the closing of the polygonal drum body with the top member of FIG. 2 to form a polygonal paperboard drum of this invention, after the bag of granular material in the drum body has been closed.

FIG. 10 is a perspective view of the closed polygonal drum of this invention, provided with a strap about the top member to hold it on the top of the drum.

FIG. 11 is a sectional view of a portion of the polygonal drum, taken along line 11—11 in FIG. 10.

FIG. 12 is a sectional view of a portion of the drum, taken along line 12—12 in FIG. 10.

DETAILED DESCRIPTION OF THE INVENTION

Figure 3:
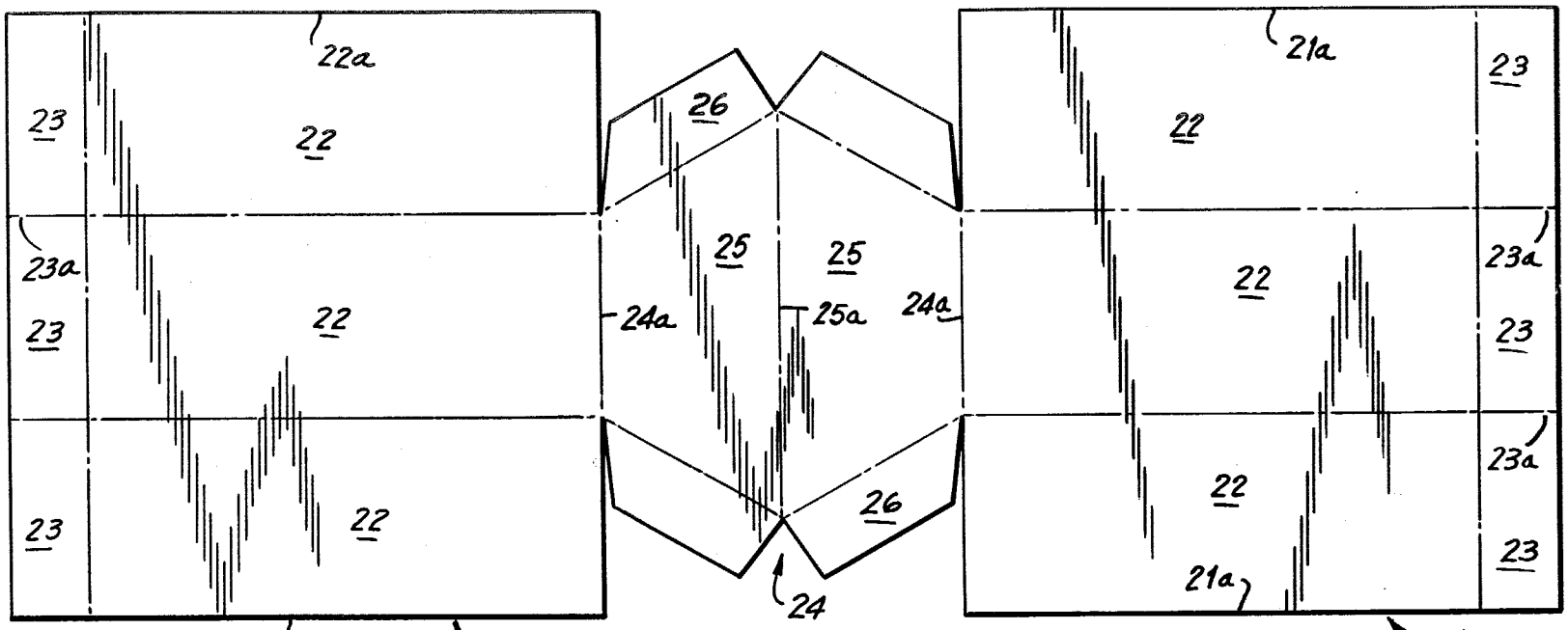
FIG. 3 is a plan view of a paperboard blank for a body member of this invention.

Shown in FIG. 1 is a substantially rectangular, one-piece, paperboard blank for a reinforcing member, generally 10, of a polygonal drum of this invention. The reinforcing member blank 10 includes at least six, preferably only six, foldably connected, substantially rectangular, reinforcing flaps 11, that are arranged in a row. It is preferred that each reinforcing flap 11 have substantially the same length and width. It also is preferred that the lateral sides 10*a* of the blank for the reinforcing member 10, at either end of the row of at least six reinforcing flaps 11, be the widthwise sides of the reinforcing member blank 10.

Shown in FIG. 2 is a paperboard blank for a top member, generally 12, of a polygonal drum of this invention. The top member blank 12 includes a polygonal central top panel 13 of at least four sides, preferably six sides. Foldably connected to each side of the top panel 13 is a substantially rectangular, top flange 14. A substantially rectangular, locking flap 15 is foldably connected to each top flange 14, along the side of the top flange remote from the top panel 13. Each locking flap 15 is adapted to be folded, relative to the top flange 14 to which it is attached, so that is underlies that top flange 14. For this purpose, two parallel fold lines 14*a* and 15*a* preferably are provided between each top flange 14 and locking flap 15 in top member blank 12. It also is preferred in top member blank 12 that the lateral sides of each top flange 14, between adjacent top flanges 14, be provided with a notch 16, preferably a semi-circular notch 16.

Shown in FIG. 3 is a paperboard blank for a body member, generally 20, of a polygonal drum of this invention. The body member blank 20 is provided with two sets, generally 21, of at least three, preferably only three, substantially rectangular, foldably connected, side wall panels 22, arranged in a row. The specific number of side wall panels 22 in the body member blank 20 is not critical, so long as it equals the number of reinforcing flaps 11 in the reinforcing member blank 10. Preferably the number of side wall panels 22 equals the number of side walls in the polygonal drum formed from the reinforcing and body member blanks 10 and 20. The particular dimensions of the side wall panels 22 also are not critical, so long as the widths of the side wall panels 22, as measured transversely of the fold lines between them, are substantially the same as the widths of the reinforcing flaps 11, as measured transversely of the fold lines between them. Preferably, the length and width of each side wall panel 22 is substantially the same. It also is preferred that the dimensions of the side wall panels 22 be substantially the same as those of the reinforcing flaps 11, with the lateral sides 21*a* of the sets 21 of side wall panels 22, at the ends of the rows of at least three side wall panels 22, being of substantially the same length as the lateral sides 10*a* of the reinforcing member blank 10.

Foldably connected to each side wall panel 22 of the body member blank 20, in FIG. 3, along one side of each set 21 of side wall panels 22, is a substantially rectangular, body flange 23. The lateral sides of the body flanges 23 are connected by tabs 23*a*, which constitute narrow unslit portions of paperboard between the body flanges 23. Foldably connected to a central side wall panel 22 of each set 21 of side wall panels 22 is a polygonal bottom panel, generally 24, of at least four sides, preferably six sides, especially six equal sides. The polygonal bottom panel 24 is connected to the central side wall panels 22 of the sets 21 of side wall panels along its opposite sides. The bottom panel 24 comprises at least two, preferably only two, foldably connected, polygonal bottom flaps 25 of at least four sides, preferably only four sides. The fold lines 24*a* connecting the bottom panel 24 to the side wall panels 22 are substantially parallel to each other and to the at least one, preferably only one, fold line 25*a* between the bottom flaps 25. Foldably connected to the other sides of the bottom panel 24 are bottom flanges 26.

Figure 4:
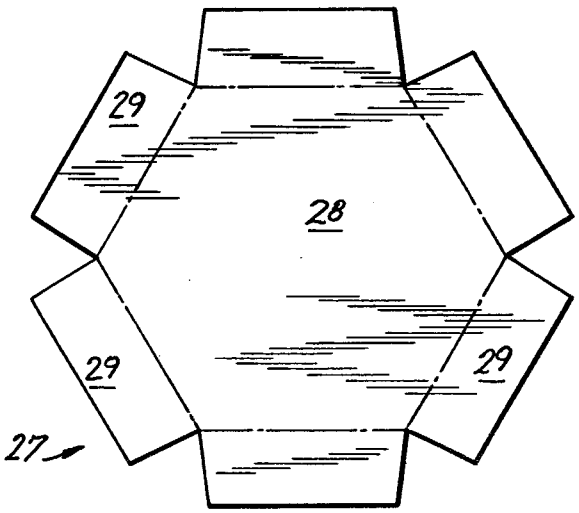
FIG. 4 is a plan view of a paperboard blank for a bottom insert of this invention.

Shown in FIG. 4 is a paperboard blank for a bottom insert, generally 27, of a polygonal drum of this invention. The bottom insert blank 27 has a central polygonal bottom reinforcing flap 28 of at least four sides, preferably six sides. Bottom insert flanges 29 are foldably connected to the sides of the bottom reinforcing flap 28.

Figure 5:
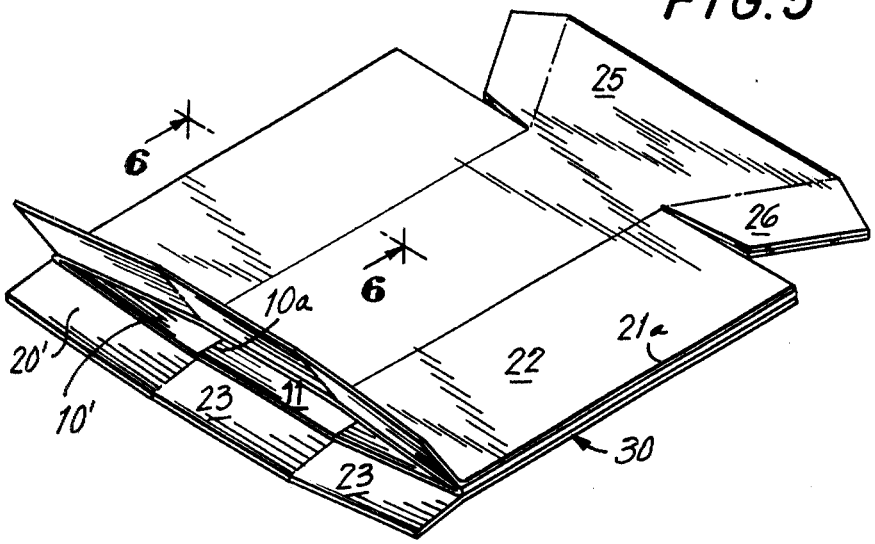
FIG. 5 is a perspective view of a collapsed drum envelope of this invention, formed from the blank for a reinforcing member of FIG. 1 and the blank for a body member of FIG. 3.
Figure 6:
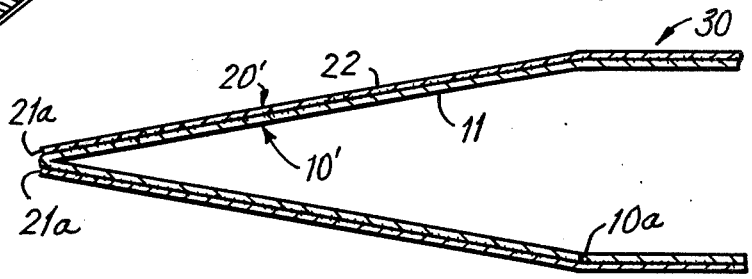
FIG. 6 is a sectional view of a portion of the drum envelope, taken along line 6—6 in FIG. 5.

Formed from the reinforcing member blank 10, shown in FIG. 1, and the body member blank 20, shown in FIG. 3, is a generally flat or collapsed, polygonal, drum envelope, generally 30, shown in FIGS. 5 and 6.

In forming the collapsed drum envelope 30, the reinforcing member blank 10 of FIG. 1 initially is folded about two of the fold lines between its foldably connected reinforcing flaps 11, so that: its lateral sides 10*a* are substantially abutting, i.e., are in contact along substantially their entire length or are at least in a closely proximate position but do not overlap; at least three of its reinforcing flaps 11 lie atop at least three other reinforcing flaps 11; and its substantially abutting lateral sides 10*a* are located either on top of or beneath at least three of its reinforcing flaps 11. Portions of the resulting folded reinforcing member 10′ are shown in FIGS. 5 and 6. Also, the body member blank 20 is folded in half about the fold line 25*a*, between the bottom flaps 25, to form the folded body member 20′ shown in FIGS. 5 and 6. The two sets 21 of side wall panels 22 of the folded body member 20′ then are provided on opposite sides of the folded reinforcing member 10′, with one set 21 of side wall panels 22 being provided beneath and adjacent to at least three reinforcing flaps 11 and the other set 21 of side wall panels 22 being provided above and adjacent to at least three other reinforcing flaps 11. The sets 21 of side wall panels 22 are provided about the folded reinforcing member 10', so that: the abutting lateral sides 10a of the folded reinforcing member 10' are located inwardly adjacent to a fold line between adjacent, foldably connected, side wall panels 22 of the folded body member 20'; and the lateral sides 21a of the sets 21 of side wall panels 22 in the folded reinforcing member 20' are in close proximity and are located outwardly adjacent to fold lines between adjacent, foldably connected, reinforcing flaps 11 of the folded reinforcing member 10'. After the folded reinforcing member 10' and the folded body member 20' are arranged in this way, the side wall panels 22 are bonded, preferably adhesively bonded, to the reinforcing flaps 11 to form the collapsed polygonal drum envelope 30 of this invention, as shown in FIGS. 5 and 6. It is preferred in forming the drum envelope 30 that each side wall panel 22 be bonded to a reinforcing flap 11, preferably over substantially the entire area of the reinforcing flap 11.

In the collapsed drum envelope 30, the bottom flap 25 connected to one set 21 of side wall panels 22 lies directly atop the bottom flap 25 connected to the other set 21 of side wall panels 22. Also, the bottom flanges 26 on one bottom flap 25 preferably overlie the bottom flanges 26 on the other bottom flap 25. Further, the bottom flanges 26, as well as the body flanges 23, preferably extend outwardly of the drum envelope 30 and lie substantially within the plane of the envelope 30. In addition, the body flanges 23 on one set 21 of side wall panels 22 preferably lie directly on top of the body flanges 23 on the other set 21 of side wall panels 22.

As seen from FIG. 6, in the collapsed drum envelope 30, the lateral sides 10a of the folded reinforcing member 10' are substantially abutting about the foldable connection between adjacent side wall panels 22 in one of the sets 21 of side wall panels. Also in the drum envelope 30, the lateral sides 21a of the sets 21 of side wall panels 22 of the folded body member 20' are in close proximity but are not overlapped and preferably are not in contact about the foldable connection between adjacent reinforcing flaps 11 of the folded reinforcing member 10'.

Figure 7:
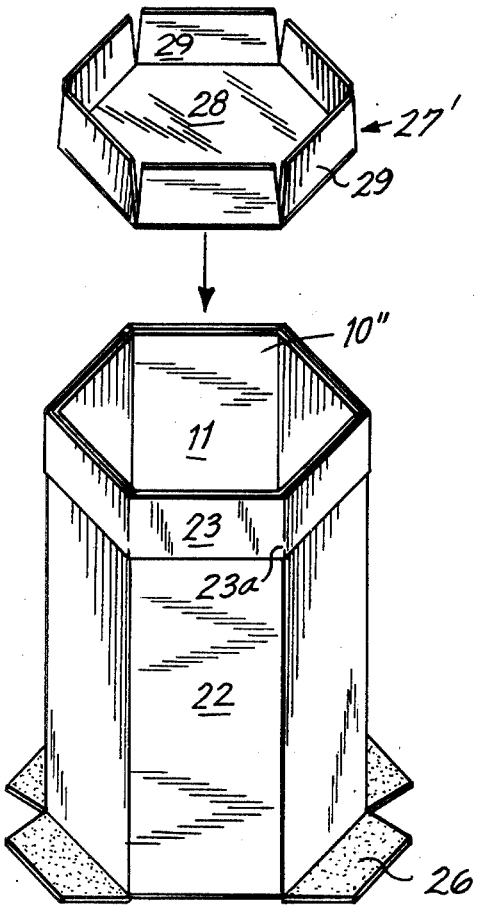
FIG. 7 is a perspective view of the assembly of an erect polygonal drum body of this invention from the drum envelope of FIG. 5 and the bottom insert of FIG. 4.
Figure 8:
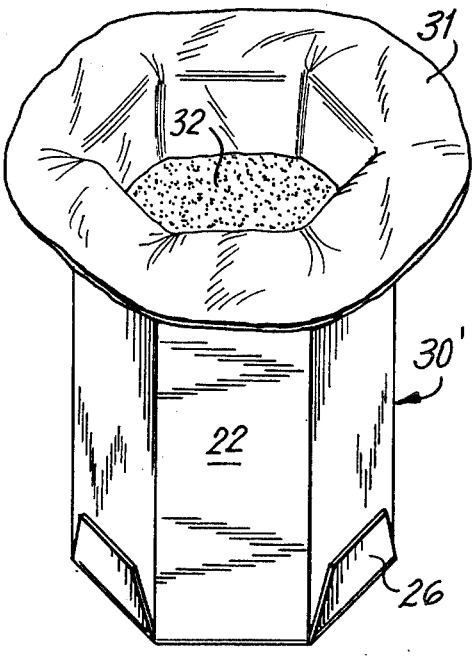
FIG. 8 is a perspective view of the assembled polygonal drum body, provided with a plastic bag for enclosing a granular material within the drum body.

Shown in FIG. 7 is the assembly of a stable and erect, polygonal, drum body 30', shown in FIG. 8, from the generally flat, collapsed, polygonal, drum envelope 30 of FIGS. 5 and 6. As seen from FIG. 7, in setting-up the drum body 30', the foldably connected, reinforcing flaps 11 of the folded reinforcing member 10' of the envelope 30 initially are formed into an upstanding, generally tubular configuration. This can be suitably accomplished by separating and standing-up the overlying reinforcing flaps 11, bonded to one set 21 of side wall panels 22, and the underlying reinforcing flaps 11, bonded to the other set 21 of side wall panels 22. The resulting upstanding tubular reinforcing member 10" is shown in FIG. 7. In converting the folded reinforcing member 10' into the tubular reinforcing member 10", the side wall panels 22, bonded to the reinforcing flaps 11, also are formed into a tubular configuration about the tubular reinforcing member 10". Also in this step, the bottom flaps 25 of the bottom panel 24 become substantially coplanar, and the bottom flanges 26 are positioned substantially perpendicular to the adjacent side wall panels 22. As a result, the bottom panel 24 then can be placed stably on a flat horizontal surface with the side wall panels 22 and reinforcing flaps 11 being in an upstanding position relative to the bottom panel 24.

Subsequently, as seen from FIG. 7, a bottom insert 27', formed from the bottom reinforcing flap 28 and the bottom insert flanges 29 of the bottom insert blank 27 of FIG. 4, is placed on top of the bottom panel 24 in order to maintain the upstanding tubular configuration of the reinforcing flaps 11 and side wall panels 22. In this subsequent step, the bottom insert 27' is placed so that the bottom reinforcing flap 28 directly overlies the bottom panel 24, with substantially the entire bottom panel 24 being covered by the bottom reinforcing flap 28, and the bottom insert flanges 29 extend upwardly, adjacent to the reinforcing flaps 11. The use of the bottom insert 27' with its bottom reinforcing flap 28 and upstanding flanges 29 is considered quite important in reinforcing the bottom of the drum body 30', as well as the polygonal drum of this invention formed from it. The bottom insert 27' also is important in holding the side wall panels and the reinforcing flaps apart, in a tubular configuration, in the drum body 30' and in the polygonal drum formed from it. If desired, in forming drum body 30', the bottom reinforcing flap 28 can be bonded, e.g., with an adhesive, to the bottom panel 24, and the bottom insert flanges 29 can be bonded to the reinforcing flaps 11. However, the bonding of these panels and flaps 11, 24, 28 and 29 is not considered necessary.

Then, as shown in FIG. 8, the bottom flanges 26 are bonded, preferably adhesively bonded, to the adjacent side wall panels 22 to form the stable and erect, polygonal, drum body 30'. The drum body 30' then can be provided with a plastic bag 31 in which is placed a granular material 32.

In assembling the drum envelope 30 and erecting the drum body 30' from the envelope 30, the position of the body flanges 23 is not considered critical. However, it is preferred that, when erecting the drum body 30' from the envelope 30, the body flanges 23 be moved relative to the side wall panels 22 so that the body flanges depend from the upstanding side walls. In this way, the portions of the plastic bag 31 defining the opening in the bag can be suitably placed outwardly of the drum body 30', adjacent to the outer surfaces of the side wall panels 22. This simplifies the filling of the bag 31 and drum body 30' with the granular material 32.

Shown in FIG. 9 are the steps in closing the drum body 30' to form the polygonal drum 30" of this invention, shown in FIG. 10. As seen from FIG. 9, after closing the plastic bag 31, containing the granular material 32, the body flanges 23 are separated from each other by breaking the tabs 23a connecting them. Then, a top member 12', formed from the top member blank 12 of FIG. 2, is placed over the open top end of the drum body 30' so that the central polygonal top panel 13 substantially conforms to the top of the drum body 30'. In closing the drum body 30' with the top member 12' to form the polygonal drum 30" of FIG. 10, the top flanges 14 preferably are placed over the body flanges 23, and the locking flaps 15 are folded relative to the top flanges 14, about fold lines 14a and 15a, so that the locking flaps 15 are located between the side wall panels 22 and the body flanges 23. The interfolded relationship of the top flanges 14, locking flaps 15 and body flanges 23 in the resulting polygonal drum 30" of this invention is clearly shown in FIGS. 11 and 12. After the top flanges 14, locking flaps 15 and body flanges 23 are interfolded, they are held together and pressed against the side wall panels 22 by means of a conventional strap 33, which preferably passes through the notches 16 in the lateral sides of the top flanges 14.

In accordance with this invention, the drum envelope 30 of FIG. 5 can be formed in a relatively quick and simple manner from the reinforcing member blank 10 of FIG. 1 and the body member blank 20 of FIG. 3. The drum envelope 30 then can be shipped, along with the top member blank 12 and bottom insert blank 27 of FIGS. 2 and 4, to a producer of granular materials in a flat condition, thereby minimizing waste in shipping them. The drum body 30' of FIG. 8 subsequently can be formed from the drum envelope 30 and the bottom insert blank of FIG. 4 in a relatively simple and quick manner, filled with granular materials, and closed with the top member blank of FIG. 2.

The polygonal drum 30'' of FIG. 10, as formed, is quite strong and has bottom and side walls that are reinforced by at least two thicknesses of paperboard material. In fact, the polygonal drum 30'' is well adapted to hold relatively heavy quantities, e.g., 75 to 500 pounds, of powdered or granular materials, such as chemicals, dyes and plastic pellets, and when filled, to be handled, stacked and stored in a conventional manner. The drum 30'' also is adapted to be easily and securely grasped about its top flanges 14 when it is being either manually or mechanically handled. Furthermore, the drum 30'' can be suitably constructed of relatively heavy and thick paperboard materials, so that it can be used for holding even greater quantities of materials, such as up to about 2,500 pounds, or used to hold liquids, pastes, slurries, etc., as well as granular materials.

The polygonal drum 30'' of this invention includes: a top wall formed by the top panel 13; a bottom wall formed by the bottom panel 24 and the bottom reinforcing flap 28; and at least four side walls, preferably six side walls, formed by the upstanding side wall panels 22 and the upstanding reinforcing flaps 11 of the upstanding tubular reinforcing member 10''. In the side walls of the drum 30'', the sets 21 of side wall panels 22 are located on opposite sides of the drum 30'' and the tubular reinforcing member 10'', and the side wall panels 22 are bonded to the reinforcing flaps 11. Also, the upstanding lateral sides **21*a* of the sets 21 of the side wall panels 22 are in substantially abutting relationship about the foldable connection between adjacent reinforcing flaps 11, and the upstanding lateral sides 10*a* of the tubular reinforcing member 10'' are in substantially abutting relationship about the foldable connection between adjacent side wall panels 22**.

The polygonal drum 30'' of this invention can, if desired, include more than four side walls, provided that the number of side walls is twice an odd integer of three (3) or greater, as, for example, six, ten or fourteen side walls. The preferred polygonal drum of this application has only six side walls, formed by two sets 21 of three side wall panels 22 and six reinforcing flaps 11. In the polygonal drum 30'', the number of sides of the top panel 13 and of the bottom reinforcing flap 28, as well as of the bottom panel 24, should be the same as the number of side walls in the polygonal drum 30'' itself, i.e., at least four, preferably only six, sides. Also in the polygonal drum 30'', the number of reinforcing flaps 11 should be the same as the number of side wall panels 22, i.e., at least six, and preferably, the number of reinforcing flaps 11 and the number of side walls in the polygonal drum 30'' are the same, preferably six. However, no matter how many side walls the drum 30'' of this invention includes, e.g., four, six, ten or fourteen, only the minimum necessary number of side wall panels 22 and reinforcing flaps 11 are provided in the drum 30'', so that there is no overlap of side wall panels 22 or of reinforcing flaps 11 in the upstanding side walls of the drum 30''. Hence, only six reinforcing flaps 11 and two sets 21 of only three side wall panels 22 are provided in the polygonal drum 30'' if it has only four or six side walls, and only ten reinforcing flaps 11 and two sets 21 of only five side wall panels 22 are provided in the polygonal drum if it has only ten side walls. The absolute minimum of three side wall panels 22 in each set 21 of side wall panels and the absolute minimum of six reinforcing flaps 11 are necessary, however, so that the reinforcing member blank 10 and body member blank 20 can properly be formed into a generally flat, collapsed, drum envelope 30 of this invention and so that the drum envelope can be properly set-up to form the tubular drum body 30' of this invention.

In the polygonal drum 30'' of this invention, any conventional, heavy duty, paperboard materials can be suitably used. Preferably, corrugated board is utilized for the various members of the polygonal drum 30'', and the corrugations in the reinforcing flaps 11 and in the side wall panels 22 are preferably at right angles to one another to provide added strength to the side walls of the drum.

In general, the particular paperboard materials used in the drum 30'' are selected to provide the drum with sufficient strength characteristics, so that it can be suitably filled with a given quantity of material, without breaking apart, and then suitably handled, stacked and transported in its intended manner, without failing. Thus, for example, when drum 30'' is designed to hold 75 to 500 pounds of granular materials, the use of a single wall corrugated board having a basis weight of about 177 to 219 pounds per 1000 square feet and a thickness of about 0.125 inch in the body member blank 20 and a double wall corrugated board having a basis weight of about 240 pounds or greater per 1000 sq. ft. and a thickness of about 0.325 inch in the reinforcing member blank 10 is frequently preferred. On the other hand, when drum 30'' is to hold greater amounts of materials or is intended to be subjected to unusually large stresses in use, considerably heavier and thicker paperboard materials are frequently preferred for the various members of the drum 30''. Thus, for example, the use of a double wall corrugated board having a basis weight of about 360 pounds or greater per 1000 sq. ft. and a thickness of about 0.375 inch or greater or a triple wall corrugated board of a basis weight of about 400 pounds or greater per 1000 sq. ft. and a thickness of about 0.50 inch or greater in the reinforcing member blank 10 is often preferred where greatly increased strength, including increased stacking strength, is needed in the drum 30''.

Also in the drum 30'', any conventional adhesive can be suitably used for bonding the various flaps and panels together. Preferably, when drum 30'' is being produced by hand, a relatively strong but slow-setting adhesive, such as a conventional polyvinylacetate adhesive, is utilized for this purpose.

Further in the drum 30'', the fold lines between various foldably connected flaps and panels can suitably be conventional scored fold lines.

Also in the polygonal drum 30'' of this invention, particular dimensions are not considered critical, provided, however, that each reinforcing flap 11 has substantially the same width as the side wall panel 22 it reinforces, as measured transversely of the fold lines between the reinforcing flaps and the side wall panels.

Preferably, the reinforcing flaps 11 have the same length as the side wall panels 22. Also, the dimensions of the reinforcing flaps 11 need not all be the same, and the dimensions of the side wall panels 22 need not all be the same, as, for example, in a polygonal drum 30'' of this invention wherein the side walls form a square or an irregular hexagon, when viewed from the top of the drum 30''. It is preferred, however, that the side walls of the drum 30'', when viewed from the top thereof, form a regular polygon, e.g, hexagon, decagon, etc., preferably a regular hexagon. Furthermore, the dimensions and proportions of the various flaps and panels of the polygonal drum of this invention can be varied widely to provide reinforced polygonal containers of differing sizes and strength properties, suitable for holding relatively heavy quantities of materials, as well as only relatively light amounts of materials.

Further in the drum 30'' of this invention, the bottom insert 27', although important, can, if desired, be dispensed with if it is not needed for reinforcing the bottom of the drum or helping to keep the sides of the drum apart, as, for example, in a very large drum 30'' that is to be handled, when filled, by means of a pallet and not by being directly lifted or rolled about the sides of its bottom panel. However, even with such a very large drum 30'', the bottom insert 27' is quite useful, inter alia, when forming its drum body 30' from its drum envelope 30 in holding its side wall panels 22 and reinforcing flaps 11 in a tubular configuration until its bottom flanges 26 are bonded to its side wall panels 22.

It is thought that the invention and many of its attendant advantages will be understood from the foregoing description, and it will be apparent that various changes may be made in the form construction and arrangement of the parts without departing from the spirit and scope of the invention or sacrificing all of its material advantages, the form hereinbefore described being merely a preferred embodiment thereof.

We claim:

1. A polygonal paperboard container, which comprises:

a one-piece, upstanding, generally tubular, reinforcing member consisting of at least six, foldably connected, substantially rectangular, upstanding, reinforcing flaps, arranged in a row; and a one-piece body member having two sets of at least three, substantially rectangular, foldably connected, upstanding side wall panels and a polygonal bottom panel of at least four sides, connected along its opposite sides to the central side wall panel of each set of side wall panels;

the sets of side wall panels being located on opposite sides of the tubular reinforcing member and the side wall panels being bonded to the reinforcing flaps;

the upstanding lateral sides of the sets of side wall panels being in substantially abutting relationship but not overlapping about the foldable connection between reinforcing flaps, and the upstanding lateral sides of the reinforcing member being in substantially abutting relationship but not overlapping about the foldable connection between side wall panels; and a substantially rectangular, body flange being foldably connected to each side wall panel along one side of each set of side wall panels remote from the bottom panel; and the lateral sides of the body flanges being connected by tabs, so that the lateral sides of the body flanges are connected until the container is to be closed.

2. The container of claim 1 wherein a polygonal top panel of at least four sides is provided at the top of the container and substantially rectangular, top flanges, foldably connected to the sides of the top panel, depend from the top panel and overlie the body flanges on the side wall panels.

3. The container of claim 2 wherein locking flaps are foldably connected to the top flanges, along the sides of the top flanges remote from the top panel, and the locking flaps are folded relative to the top flanges so that they are located between the side wall panels and the body flanges.

4. The container of claim 3 wherein the reinforcing member has only six reinforcing flaps and the body member has two sets of only three side wall panels; wherein the bottom panel is hexagonal and a hexagonal bottom reinforcing flap, overlying substantially the entire bottom panel, and six upstanding bottom insert flaps, foldably connected to the sides of the bottom reinforcing flap, are provided in the container; and wherein the top panel is hexagonal and six top flanges, each having a locking flap connected thereto, are provided in the container.

5. A generally flat, collapsed envelope for a polygonal paperboard container, which comprises:

a one-piece reinforcing member, consisting of at least six, foldably connected, substantially rectangular, reinforcing flaps, arranged in a row; and a one-piece body member, formed by two sets of at least three, substantially rectangular, foldably connected, side wall panels, arranged in a row, and a polygonal bottom panel of at least four sides, formed from two foldably connected, polygonal, bottom flaps and foldably connected along its opposite sides to the central side wall panel of each set of side wall panels;

the lateral sides of the reinforcing member being in substantially abutting relationship but not overlapping;

one bottom flap of the bottom panel lying directly atop the other bottom flap of the bottom panel;

the sets of side wall panels being located on opposite sides of the reinforcing member, the side wall panels being bonded to the reinforcing flaps, and the lateral sides of one set of side wall panels being in close proximity to but not overlapping the lateral sides of the other set of side wall panels;

the abutting lateral sides of the reinforcing member being located inwardly adjacent to a fold line between adjacent side wall panels of the body member and the closely proximate lateral sides of the sets of side wall panels of the body member being located outwardly adjacent to fold lines between adjacent reinforcing flaps of the reinforcing member;

a substantially rectangular, body flange being foldably connected to each side wall panel along one side of each set of side wall panels remote from the bottom panel; and the lateral sides of the body flanges being connected by tabs, so that the lateral sides of the body flanges are connected until the container is to be closed.

6. The collapsed envelope of claim 5 wherein the reinforcing member has only six reinforcing flaps and the body member has two sets of only three side wall panels.

* * * * *

UNITED STATES PATENT AND TRADEMARK OFFICE

CERTIFICATE OF CORRECTION

PATENT NO. : 4,166,567

DATED : September 4, 1979

INVENTOR(S) : Ralph L. Beach, Jr., et al

It is certified that error appears in the above-identified patent and that said Letters Patent are hereby corrected as shown below:

at column 2, line 33, "2,5000" should be -- 2,500 -- ;

at column 9, line 44, "consisting of" should be -- having -- ;

at column 9, line 49, after "panels", should be inserted -- , arranged in a row, -- ;

at column 10, line 28, "consisting of" should be -- having -- ; and at column 10, line 31, "formed by" should be -- having -- .

Signed and Sealed this

First Day of January 1980

[SEAL]

*Attest:*

SIDNEY A. DIAMOND

*Attesting Officer*

*Commissioner of Patents and Trademarks*